United States Patent [19]

Detzer et al.

[11] Patent Number: 4,697,435

[45] Date of Patent: Oct. 6, 1987

[54] APPARATUS FOR HUMIDIFYING, CLEANING AND COOLING OF GASES

[75] Inventors: Rüdiger Detzer, Alten-Buseck; Werner Loew, Wetzlar; Franz Kohnen, Giessen, all of Fed. Rep. of Germany

[73] Assignee: Kessler + Luch GmbH, Giessen, Fed. Rep. of Germany

[21] Appl. No.: 922,149

[22] Filed: Oct. 23, 1986

[30] Foreign Application Priority Data

Oct. 23, 1985 [DE] Fed. Rep. of Germany ..... 3537671

[51] Int. Cl.[4] ..... F28D 5/00

[52] U.S. Cl. ..... 62/304; 55/233; 261/140.1

[58] Field of Search ..... 62/91, 304, 309, 311; 55/220, 223, 230, 231, 233; 261/140 R

[56] References Cited

U.S. PATENT DOCUMENTS 2,786,406 3/1957 White ..... 62/309 X 3,362,186 1/1968 Patterson ..... 62/304 X

*Primary Examiner*—Henry A. Bennet

*Attorney, Agent, or Firm*—Herbert L. Lerner; Laurence A. Greenberg

[57] ABSTRACT

Apparatus for humidifying, cleaning and cooling of gases, especially air, with a filter layer disposed in the gas stream and a device for supplying it with liquid. The apparatus has a cuboid housing with upper inlets for outside and/or ambient air. In the housing is disposed at least one cage with a polygonal cross section and closed below. The upper surface of the cage is only partially covered by a centrally located fan, leaving a wide outer ring gap. Underneath the fan is an annular spray nozzle for the distribution of the liquid, mainly water, on an inner cage wall formed by a filter layer. The housing is equipped in its lower part with air outlet openings and in its upper part, partially covering the cage, with a channel for return of the air coming out of the cage to the annular gap at the fan.

14 Claims, 4 Drawing Figures

APPARATUS FOR HUMIDIFYING, CLEANING AND COOLING OF GASES

BACKGROUND OF THE INVENTION

1. Field of the Invention

The present invention relates to an apparatus for humidifying, cleaning and cooling of gases, particularly air, with a filter layer disposed in the gas stream and a device for supplying it with a liquid.

2. Description of the Prior Art

Such apparatus is mainly, but not exclusively used for the supply with or circulation of air in greenhouses. It is important that selectively outside air or ambient air is treated.

In known apparatus according to the species the filter layer is disposed at an angle to the direction of the incoming and/or outgoing air, and the device for supplying a liquid to the filter consists of a nozzle disposed upstream from the filter, but downstream from a fan. The filter layers of known apparatus are regularly disposed at an angle to the direction of air flow, for the purpose of making a larger pass-through area of the filter available. Insofar as "filters" are mentioned in connection with the state of the art and the present invention, gas or air permeable layers of material of any structure are meant which, however, not only filter the air or the gas, but are also supplied with liquid in order to moisten the air by means of their surfaces which are considerably enlarged because of fine stratification. During the process of moistening, a cooling of the air or the gas also takes place.

In known apparatus according to the species uneven moistening of the filter occurs in case the fan is located close to the filter arrangement because of the generally circularly defined form of the discharge air of the fan, which results in different flow-through speeds in the several areas of the filter; the spray nozzles for the liquid are generally "punctiform", so that uneven moistening of the several areas of the filter also occurs. The result is an unsatisfactory and ineffective treatment of the gaseous medium. If the fan is disposed at a distance from the filter, it is, for instance, possible to achieve an even supply of the filter by corresponding guidance of the stream, but the structural volume of the total apparatus is considerably enlarged—in general, such an arrangement is feasible only when the stream of the gaseous medium is guided in a channel.

SUMMARY OF THE INVENTION

An object of the invention is to provide an apparatus of the species having as small as possible a structural volume, to achieve an even and therefore controllable and calculable moistening and, if need be, cooling of the gaseous medium and, above all, to achieve an optimal moistening and, if need be, cooling of the gaseous medium.

With the foregoing and other objects in view, there is provided in accordance with the invention an apparatus for humidifying, cleaning and cooling of gases, especially air, comprising: a cuboid housing with at least one upper gas inlet disposed in the upper portion of the housing for the introduction of a stream of gas to be treated by humidifying, cleaning and cooling, at least one cage having a polygonal cross section and closed at its bottom extending downwardly in the housing from a point below the upper gas inlet, a fan centrally located with respect to the cage partially covering the upper surface of the cage leaving an outer ring gap, an inner cage wall formed by a filter layer, an annular spray nozzle disposed underneath the fan for the distribution of liquid, mainly water, gas outlet openings at the lower part of the housing for the discharge of gas passing through the cage, and a space between the outer surface of the cage and the inner surface of the housing for providing a passageway for the return of part of the gas passing through the cage to the outer ring gap at the fan.

Other features which are considered as characteristic for the invention are set forth in the appended claims.

Although the invention is illustrated and described herein as embodied in apparatus for humidifying, cleaning and cooling of gases, it is nevertheless not intended to be limited to the details shown, since various modification may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DESCRIPTION OF THE PREFERRED EMBODIMENTS

Figure 1:
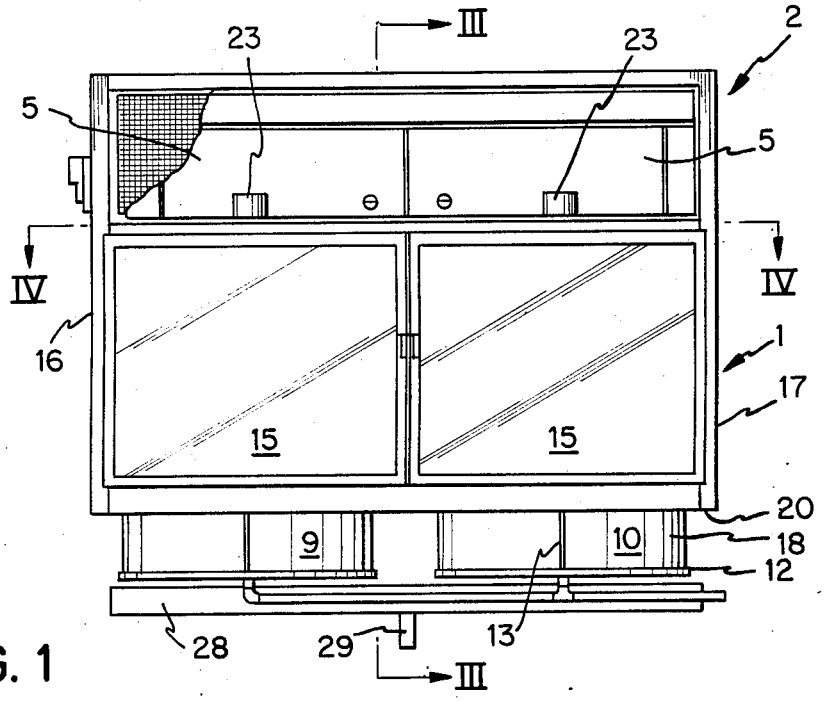
FIG. 1 is a frontal view of an apparatus in accordance with the invention.
Figure 2:
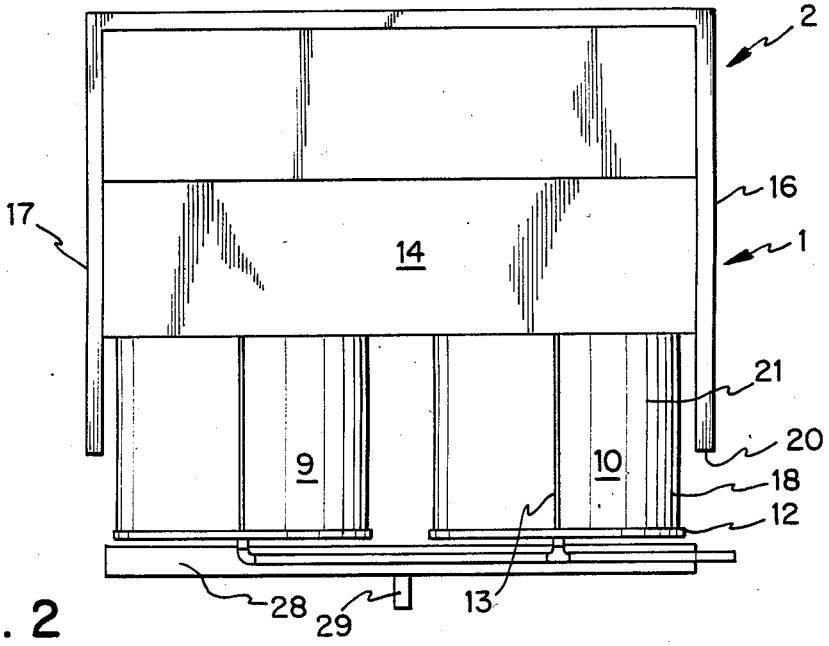
FIG. 2 is a rear view.
Figure 3:
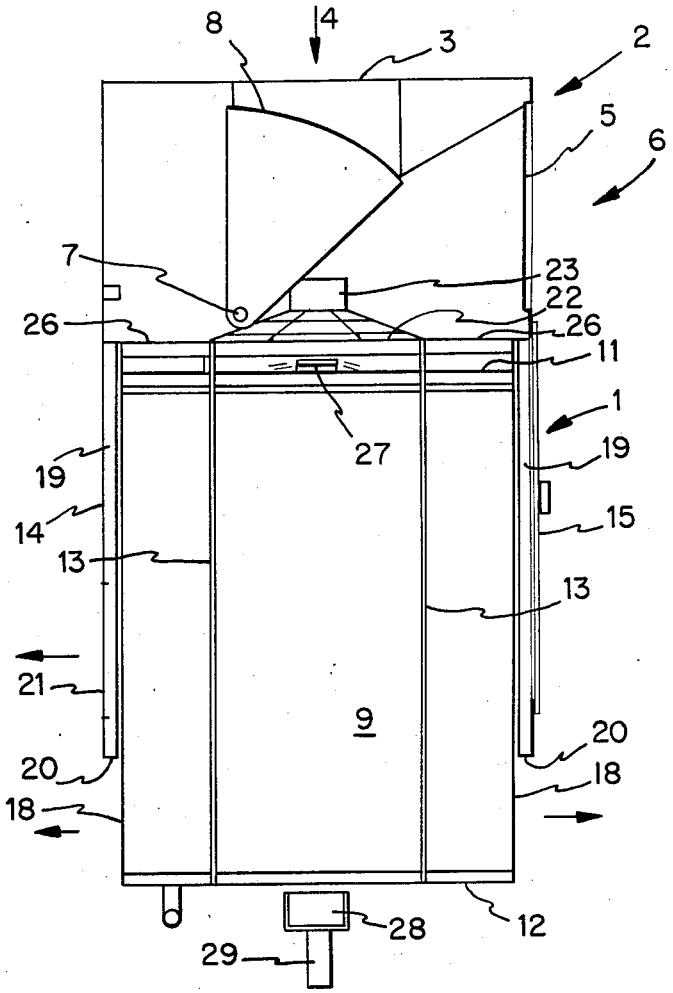
FIG. 3 is a section taken along line III—III of FIG. 1.
Figure 4:
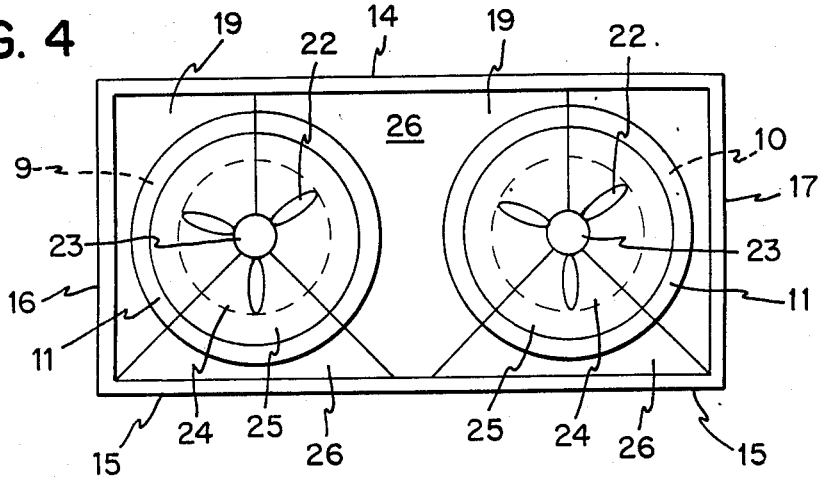
FIG. 4 is a section taken along line IV—IV of FIG. 1.

An apparatus of the in accordance with the invention is characterized in that it has a cuboid housing with upper inlets for outside and/or ambient air; at least one cage with a polygonal cross section, closed at the bottom, is disposed in the housing; the top side of the cage is only partially covered by a fan disposed centrally, leaving open a wide outer annular gap, and having underneath the fan an annular spray nozzle for the distribution of a liquid, mainly water, on the inner cage wall formed by a filter layer, and wherein the housing is provided in its lower part with air discharge openings and in its upper part which partially covers the cage with a return of the air coming out of the cage to the annular gap. The cage is preferably in the form of a cylinder.

Further characteristics of the apparatus according to the invention are discussed in the following description.

Because of the disposition of the filter layer in the walls of a cylinder having a polygonal or circular cross section, an even supply of air to all areas of the filter results, even when the fan is disposed immediately above the cylinder and therefore the filter layer, thus achieving a very compact structural form and a small structural volume. Because of the form of the filter layer its moistening by the spray nozzle is also very even and in all areas such that the passing air is optimally moistened. An especial advantage is achieved in that in the upper area of the cylinder-like filter, air emerging from it is recycled, because of the corresponding cover, to the annular gap existing between the fan and the upper opening of the cylindrically formed filter. By means of the air stream created by the fan, which is directed into the cylinder, a low pressure is created at this annular gap. Ambient air is aspirated because of induction effect of this low pressure. In accordance with the invention care is taken that this aspirated air is air emerging from the upper areas of the cylinder-shaped filter and has there been already well moistened and, if need be, cooled. Thus this air is repeatedly forced through the filter and thereby repeatedly moistened and, if need be, cooled. This results in an improvement of the degree of moistening of up to 10% and, with it, an improved cooling, if need be, of the air finally emerging from the apparatus. In accordance with the invention not only a compact structure of the entire apparatus is achieved, but also a considerable improvement of its efficiency.

The invention is further disclosed by means of an exemplary embodiment in relation to the drawings.

The upper part 2 of a cabinet-like housing 1 is formed as an air guide chamber. An upper opening 3, extending across approximately the entire length of the housing, forms the fresh air inlet in accordance with arrow 4 and a side opening 5 forms the ambient air inlet according to arrows 6. A flap 8, movable by about a quarter circle around a fulcrum 7, is used to alternately close and open the two inlets 3 and 5, wherein, of course, intermediate positions are possible, so that both openings 3 and 5 are partially open.

Two cylinders 9 and 10 are disposed in the housing underneath the air guide chamber 2. These cylinders are formed by an upper collar 11, which can have an angular profile, and a lower end plate 12 with the same outer circumference as the upper collar 11. A cylinder is formed between the upper collar 11 and the plate 12 consisting of a filter medium, for instance of an open-pore foam. This cylinder of foam material can be equipped on its outside with a reinforcement, for instance material in the shape of a coarse-meshed web lattice. The cylinder of foam material is supported between the collar 11 and the plate 12 by means of rods 13 evenly distributed around the circumference and fixed to the collar 11 as well as the plate 12. At least two of the rods 13 are removably fastened and can be easily removed in order to allow removal of the filter cylinder held between them, either to exchange the filter cylinder or to wash and clean it.

The filter cylinder can also be made of different layers, for instance, it can have a large fiber web on the inside and be formed in its outer layers of foam material with open pores. The filter can also consist of different filter media in its vertical division, i.e. that the cylindrical filter consists in its upper part of a filter medium having less air resistance than the filter medium in the lower part. The importance of this step will become clear from the following explanation.

Underneath the air guide chamber 2, having the same layout, the housing covers the cylindrical filter(s) 9 or 9 and 10 with walls 14 and 15 on the long side as well as walls 16 and 17 on the short sides such that a lower area 18 of the cylindrical filters is not covered. The housing walls 14 to 17 are spaced from the cylindrical filters 9 (and 10) to form an air guide channel 19. The wall 15 is provided on one side with flaps or doors which can be opened.

In accordance with the preferred embodiment, the lower edges of the side walls 14 to 17 are provided with end covers 20, which are guided towards the cylindrical filter 9 or 10 and which can abut against it. Appropriately these end covers 20 are formed such that they are height-adjustable by means of a wall part gliding telescopically behind the lower edge of the fixed wall, so that the free lower area 18 of the cylindrical filters can be variable adjusted, i.e. it can be enlarged or reduced. The humidified, cleaned and, if need be, also cooled air flows out from here. Instead, additional openings 21 could be provided in a fixed housing wall, for instance wall 14, serving as outflow flaps for the air and appropriately openable as required by sliding.

A bladed fan 22, the motor of which is designated 23, is disposed above the upper open part of the cylindrical filters. The fan 22 with its arc 24 of its blades does not cover the entire circumference of the cylindrical filter—the annular gap 25 lies in between. The ratio of the width of this annular gap 25 at the fan to the diameter of the cylinder 9 or 10 is about 1:6.

During operation the airstream generated by the fan 22 and directed into the cylindrical filter aspirates air, in a manner of speaking secondary air, through the annular gap, which air is also forced into the area surrounded by the cylindrical filters. Based on the construction of the housing described above, this air is drawn from the air guide channels 19 and therefore from the upper area of the cylindrical filter. An intermediate plate 26 is disposed between the fan, or between the outer circumference of the circle traversed by the fan blades, and the inside of the housing walls to assist this aspiration effect. Appropriately the support of the fan rests on this intermediate plate 26.

This intermediate plate 26 closes the air guide channels 19 inside the outer walls of the housing at a distance above the collar 11, bearing the upper edge of the cylindrical filter, and covers the annular gap 25, so that the secondary air induced by the airstream generated by the fan is aspirated from the covered upper part of the cylindrical filter. An air circulation, so to speak, takes place in the upper part of the filter, wherein this reaspirated air, however, reaches the lower part of the cylindrical filter because of its greater density based on the moistening and, if need be, cooling, earlier, so that finally, after repeated passage through the filter, it is discharged in the lower area 18 of the filter.

An annular spray nozzle 27 is disposed beneath the fan. Nozzle 27 moistens the air blown in by the fan and also evenly moistens the filter walls from the inside, so that the air forced through there is again moistened. Excess liquid runs down inside the filter, is collected by the plate 12 which closes the filter at the bottom. The water runs through an opening or openings, not shown, from plate 12 into a collector 28 and into a discharge 29 in the center of the collector 28. According to the exemplary embodiment described above, the filter is cylindrically constructed. Of course, the filter can also have a polygonal shape, for instance it can be formed octagonally if, for instance, a filter medium must be used which is only available in mats and cannot be bent into a cylinder. Then single even sections of the mats are formed into an octagonal polygon, for instance, wherein the mats rest on the rods 13 with the touching edges of the mats glued together. When using a polygonically formed filter cylinder it is not even necessary to adapt the upper support collar 11 and the plate 12 to the polygonal cross section; collar 11 and plate 12, with their flanges directed downwardly or upwardly, overlap the upper and lower edges of the filter sufficiently to give a satisfactory seal. The term polygonal cross section as used in the claims is intended to include a cross section of a cylinder.

There is claimed:

1. An apparatus for humidifying, cleaning and cooling of gases, especially air, with a filter layer disposed in the path of a gas stream to be treated and a device for supplying the gas stream with liquid, comprising: a cuboid housing with at least one upper gas inlet disposed in the upper portion of the housing for the introduction of a stream of gas to be treated by humidifying, cleaning and cooling, at least one cage having a polygonal cross section and closed at its bottom extending downwardly in the housing from a point below the upper gas inlet, a fan centrally located with respect to the cage partially covering the upper surface of the cage leaving an outer ring gap, an inner cage wall formed by a filter layer, an annular spray nozzle disposed underneath the fan for the distribution of liquid, mainly water, gas outlet openings at the lower part of the housing for the discharge of gas passing through the cage, and a space between the outer surface of the cage and the inner surface of the housing for providing an air channel for return of part of the gas passing through the cage to the outer ring gap at the fan.

2. An apparatus according to claim 1, wherein the cage is cylindrical in form.

3. An apparatus according to claim 1 wherein the gas is air, wherein the uppermost part of the housing above the fan is formed as an air guide chamber having an opening at a side of the housing for introduction of ambient air and, at right angles thereto, an opening for introducing outside air, and a sector-shaped swivel plate whereby both openings can alternatively be closed or, in reciprocal relation to each other, be opened.

4. An apparatus according to claim 1, wherein the housing is provided with end coverings for the return of the moistened air to the annular gap.

5. An apparatus according to claim 4, wherein the end coverings of the housing, which separate the air to be returned from the exhausted air, are adjustable in respect to the height of the covering.

6. An apparatus according to claim 1, wherein a plate closes the cylindrical cage at the bottom, and wherein a collector and discharge conduit are disposed beneath the plate for the collection and return of the excess sprayed liquid from the plate to the annular spray nozzle.

7. An apparatus according to claim 1, wherein a cylindrical filter is inserted in the cylindrical cage as an inner cylinder mantle.

8. An apparatus according to claim 7, wherein the cylindrical filter is air permeable and waterproof.

9. An apparatus according to claim 7, wherein the cylindrical filter consists of a fiber web.

10. An apparatus according to claim 7, wherein the cylindrical filter consists of a foam material with open pores.

11. An apparatus according to claim 2 wherein the cylindrical filter is vertically divided into a part with less air resistance and greater wetting capability in the upper part which is covered by the housing for chanelling of the air, and into a lower part with higher air resistance and lesser wetting capability.

12. An apparatus according to claim 2, wherein the ratio of the width of the annular gap at the fan to the diameter of the cylinder is about 1:6.

13. An apparatus according to claim 2, wherein the cylindrical cage is formed by rods fixed to an upper collar at the top of the cage and a plate at the bottom of the cage.

14. An apparatus according to claim 13, wherein two or more neighboring rods of the cylindrical cage are fastened so they can be easily removed in order to exchange the cylindrical filter inserted in the cage.

* * * * *